United States Patent [19]

Pichl

[11] 4,119,054

[45] Oct. 10, 1978

[54] TRIMMABLE AND TILTABLE OUTBOARD MOTOR

[75] Inventor: Heinz Pichl, Upsala, Sweden

[73] Assignee: AB Volvo Penta, Gothenburg, Sweden

[21] Appl. No.: 827,004

[22] Filed: Aug. 23, 1977

[30] Foreign Application Priority Data

Aug. 27, 1976 [SE] Sweden ..... 7609501

[51] Int. Cl.[2] ..... B63H 5/12

[52] U.S. Cl. ..... 115/41 HT; 115/17

[58] Field of Search ..... 115/12 R, 17, 18 R, 115/41 R, 41 HT; 248/4

[56] References Cited

U.S. PATENT DOCUMENTS

| | | | |
|---|---|---|---|
| 2,972,328 | 2/1961 | Hodgson | 248/4 |
| 3,269,351 | 8/1966 | Shimanckas | 115/18 R |
| 3,581,702 | 6/1971 | Moberg | 115/41 HT |

FOREIGN PATENT DOCUMENTS

| | | | |
|---|---|---|---|
| 2,005,206 | 12/1969 | France | 248/4 |

*Primary Examiner*—Trygve M. Blix
*Assistant Examiner*—Jesus D. Sotelo
*Attorney, Agent, or Firm*—George H. Baldwin; Arthur G. Yeager

[57] ABSTRACT

An outboard motor mount including an upright T-shaped mounting element swingably supported by a transom bracket, the motor being tiltable on the horizontal beam or arms of the mounting element. The mounting element is adjustable in height and in inclination with respect to the transom and the motor is adjustably linked to the leg of the mounting element to adjust the normal operating angle of the motor.

15 Claims, 7 Drawing Figures

TRIMMABLE AND TILTABLE OUTBOARD MOTOR

The present invention relates to a device at an outboard motor which can be trimmed and tilted by being swung upwardly. The relatively small swinging movement around a horizontal axis by means of which the propeller shaft is brought into an optimum position in the water for driving the boat is herein referred to as trimming, while by tilting is meant the larger angular movement around a horizontal axis by means of which the motor is swung upwards at least to a position where the skeg of the motor is located at the same level as the bottom of the boat with the propeller out of water.

With most outboard motors, trimming and tilting have been manually accomplished, except for the swinging movement upwards which occurs when the immersed portion of the motor hits an obstacle in the water. Especially with larger and therefore heavier outboard motors, the tilting or swinging up of the motor requires considerable strength and effort, and furthermore, both while trimming as well as at tilting, the operation itself has to be carried out at the boat transom where the motor is placed, whereas the lateral steering, shifting and throttle controls may be remotely controlled from a drive station forward in the boat. To provide for control of tilting, at least with respect to trim adjustments, from the control station is desirable for convenience, as well as to permit the person while operating the boat to effect such adjustments while under way. For these reasons, it has previously been proposed to mount the steering shaft of an outboard motor, that is, the shaft which in the driving position is generally upright and extends substantially vertically and around which the motor is turned sidewards for obtaining the lateral steering of the boat, for swinging on a horizontal axis and to arrange a hydraulic cylinder-piston assembly between the steering shaft and the boat transom, or between the steering shaft and the transom bracket for the motor. By remote control of the cylinder-piston assembly from the forwardly located control station, all the necessary trimming and tilting movements may thus be obtained. The hydraulic pump for feeding pressurized fluid to the cylinder-piston assembly in such systems is arranged outside the outboard motor.

The object of the present invention is to provide a bracket assembly for an outboard motor which offers higher stability and which is especially well suited for being supplemented by at least one cylinder-piston arrangement to achieve remotely controlled trimming and tilting.

The invention is especially well suited for being used with motors having low vibrations, for instance opposed piston motors or electrical motors, since this allows the motor to be attached to the boat transom in a low-resilient support without any particular means for the absorption of vibrational shocks, which otherwise might be necessary. The assembly according to the invention allows that also when one or several cylinder-piston arrangements are used, an undivided steering shaft may be used, which is a constructional advantage and a simplification. The possibility of easily obtaining continuous trimming from the driver's station, brings also with it the advantage that the function of the trimming rudder may be used better. Furthermore, the arrangement according to the present invention also has the substantial advantage that by trimming of the outboard motor also its state in respect of, under-steering and over-steering can be readily influenced, whereby it is, for instance, possible to choose a position where a minimum steering force is required.

The invention is further elucidated with reference to the accompanying drawings which refer to exemplary embodiments and where:

FIG. 1 is a perspective view of a steering shaft with a transverse beam;

FIG. 2 discloses an alternative embodiment of the upper end portion of a steering shaft with a transverse beam;

FIGS. 3 and 4 disclose two alternative embodiments of the lower portion of the steering shaft;

Figure 1:
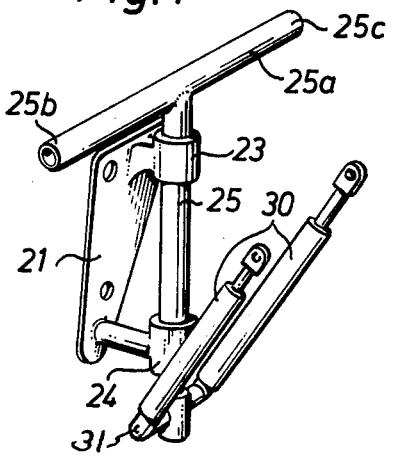
Figure 6:
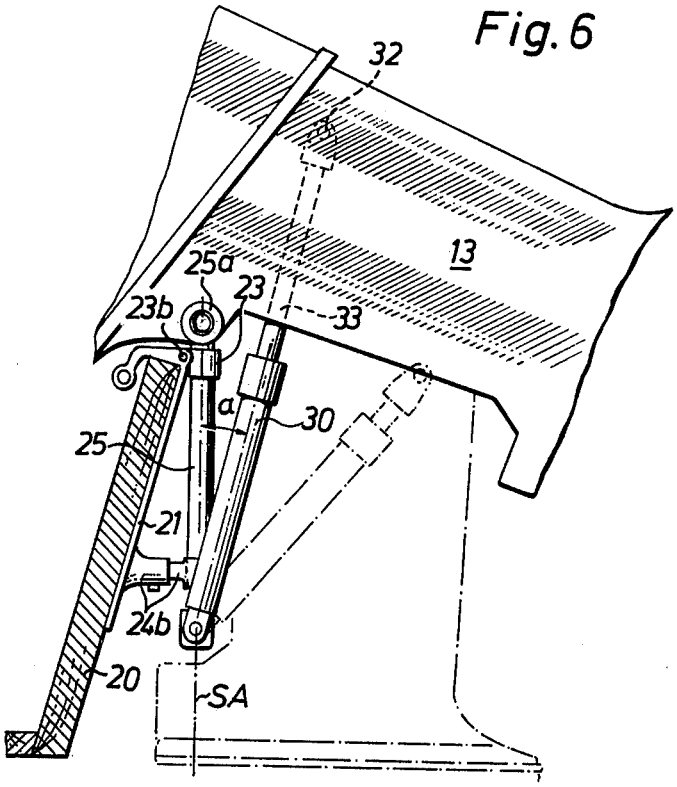
FIG. 6 shows the motor of FIG. 5 and the cylinder-piston assembly, partially in fragment and broken lines, with the motor in maximum tilted position.
Figure 5:
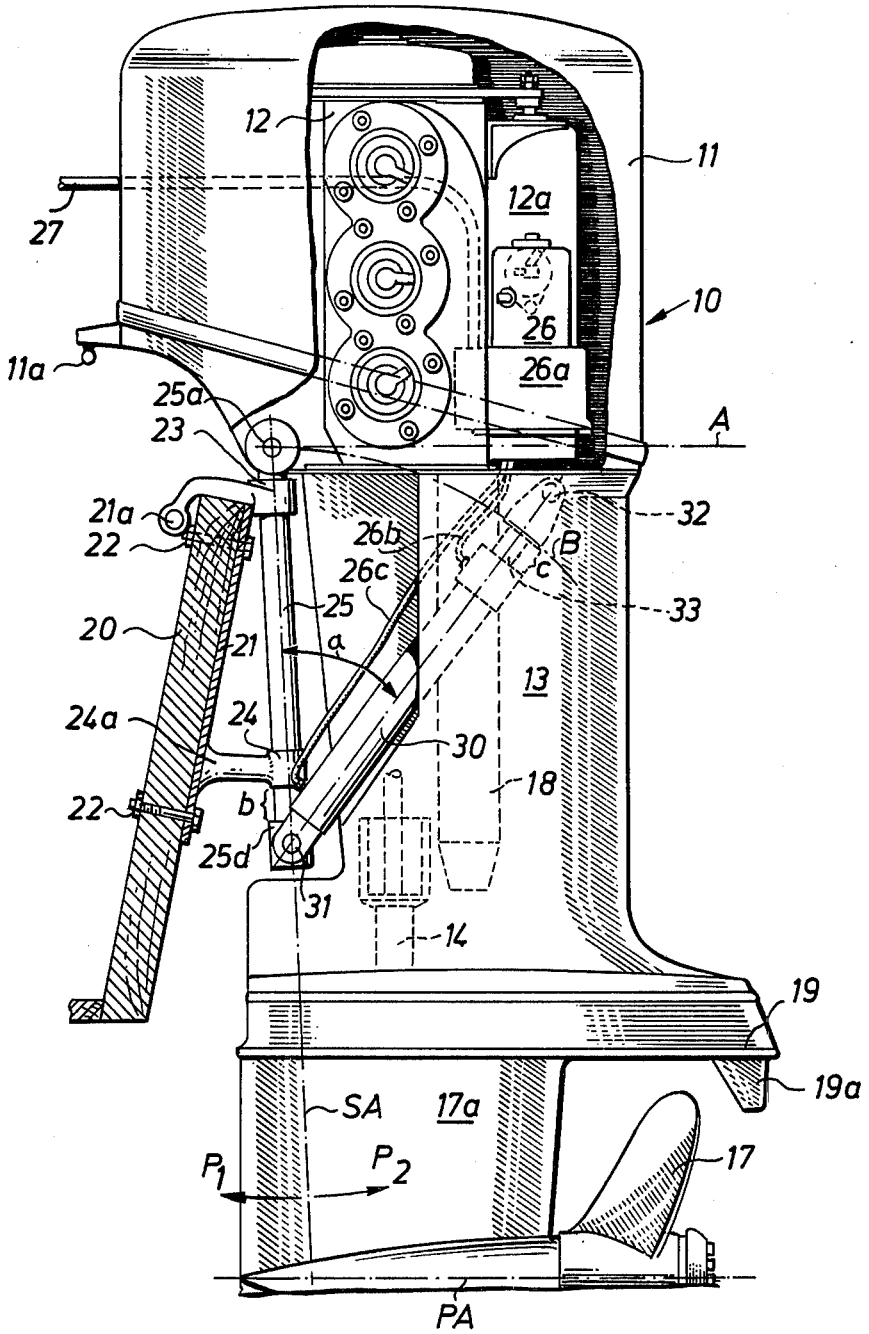
FIG. 5 is a schematic side view of an outboard motor provided with the bracket assembly according to the present invention and having two cylinder-piston assemblies, the motor being shown in its normal upright drive position.

According to FIG. 1, there is at a transom attachment bracket 21, intended for being attached to the transom 20 of a boat shown in FIGS. 5 and 6. This bracket rotatably supports steering shaft 25 by means of an upper bearing 23 and a lower bearing 24. The upper end of the steering shaft 25 fixedly carries a transverse member **25*a*, and an outboard motor 10 shown in FIG. 5, is swingably mounted at terminal portions 25*b* and 25*c* thereof. By swinging or rotating around the horizontal axis embodied by the transverse cross piece 25*a***, trimming and tilting is obtained in a manner further elucidated in the following.

Figure 2:
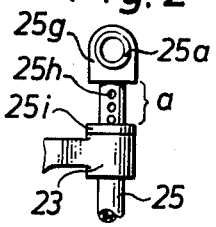

In order that also height trimming, i.e. adjustment of the height of the motor and thereby also of the propeller in its driving position relative to the boat may be accomplished, the steering shaft 25 is preferably made adjustable in the height direction, basically in that it is made longer than what corresponds to the distance between the upper and the lower bearings 23 and 24. The selected height position may be secured in different ways. According to an alternative shown in FIG. 2, the transverse piece **25*a* is not fixedly attached to the steering shaft 25, but it is mounted in a block 25*g* with a transverse opening therethrough. Between the upper shoulder surface of the upper bearing 23 and the lower shoulder surface of the block 25*g*** there is a distance *a* on the steering shaft 25 for height adjustment purposes. The selected height position is secured by means of a pin (not shown) in any of the openings **25*h* in the steering shaft, preferably assisted by an intermediate washer 25*i* which serves as a thrust bearing for the pin, or alternatively in that at the mounting on the boat a certain number of such intermediate washers 25*i* are slipped on the steering shaft between the upper bearing 23 and the block 25*g***.

Figure 3:
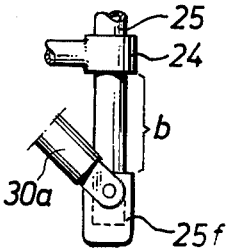

In FIG. 3 there is shown an alternative possibility of the height adjustment of the steering shaft 25. The lower end of the steering shaft protrudes a distance *b* below the lower bearing 24 and is disposed in a cup-shaped bearing **25*f*. To this bearing a cylinder-piston assembly 30*a*, or one such cylinder and piston on each side thereof is pivotally attached, the other end of the one or two cylinder-piston assemblies being pivotally attached to the transom plate 21**. This solution allows for remote control also of the height trimming and is especially of advantage when, as will be described in the following, a pressurized fluid source for driving the tilting and trimming cylinder-piston means is already provided.

With manual trimming and tilting, the motor mounted on the transverse piece 25*a* is maneuvered basically in the same way as when it, in conventional manner, is supported on a single centrally located place.

However, according to FIG. 1 two cylinder-piston assemblies 30 are attached to the lower end of the steering shaft, and these assemblies are not directed towards the transom attachment 21 to serve for height trimming as shown in FIG. 3, but they extend upwardly and rearwardly for attachment to the outboard motor 10, according to FIGS. 5 and 6. According to these figures, an outboard motor 10 comprises a motor housing 11, which for the sake of clarity is shown partially broken away and wherein the motor 12 itself, a six-cylinder opposed cylinder motor in the embodiment shown, is accommodated, and a leg housing 13 in which the output drive shaft 14 of the motor extends downwardly in order to drive the propeller 17 via a not shown bevel gear in the gear and propeller housing 17*a*. The propeller shaft is symbolized in the drawing by its dash-dotted axis PA. Furthermore, in the leg housing 13, is an exhaust passage 18, and on the external side thereof, is an anticavitation plate 19. A trim tab 19*a* is mounted below the anticavitation plate 19.

The motor 10 is carried by the transom 20 of the boat by means of the transom attachment bracket plate 21 which is held at the transom by means of attachment screws 22 and which thus supports the upper bearing 23 and the lower bearing 24 for the steering shaft 25. Thanks to an arm 24*a*, the lower bearing 24 is located a greater distance from the boat transom 20 than the upper bearing 23, which in the present case is a particular advantage which will be described later on. At the transom attachment there is also arranged an attachment 21*a* (FIGS. 5 and 6) for the end piece of the cable cover of a single cable steering device as further shown in FIG. 7. The active inner part of the steering cable is attached to the steering arm of the motor at the ball attachment 11*a* via a steering rod 41 best shown in FIG. 7.

The steering shaft 25 has the T-shaped appearance as shown in FIG. 1. At the two ends 25*b*, 25*c* of the transverse piece or beam 25*a*, the motor 10 is pivotally attached. At the lower end 25*d* of the steering shaft, the two identical and parallel coupled cylinder-piston units 30, by means of bearings not disclosed in detail, are pivotally attached to the steering shaft at 31. The upper ends of the cylinder-piston units are pivotally attached to the motor, spacedly on respective opposite sides thereof as seen at 32 as seen in FIGS. 5 and 6. The attachments 32 are preferably located in a position which in the height direction is limited to be between a plane A which passes through the transverse beam 25*a* and is parallel to the propeller shaft axis PA, and an arc of a cylindrical locus B, which passes through the same transverse beam 25*a* and has its center of curvature coincident with the axis of the pivotal connection 31. Thus the distance of the connection or connections 32 from the transverse beam 25*a* in the longitudinal direction, there is, the longitudinal direction of the boat, is so selected that when the motor is in its normal upright drive position shown in FIG. 5, when the propeller shaft axis PA is substantially parallel to the water line of the boat, the angle $\alpha$ (FIG. 5) between the axis of the steering shaft 25 and the axes of the cylinder-piston units does not exceed 55° to 75° and is, thus, always a pronouncedly acute angle. In the disclosed exemplary embodiment, the angle $\alpha$ is 40°. The support of the motor 10 at the terminal end portions 25*b*, 25*c* of the transverse beam 25*a* of the specially shaped steering shaft 25 results in increased stability in all trimming and tilting positions, which stability may be further enhanced by locating the attachment ends 32 at a greater lateral distance, apart than the attachment ends 31, whereby the cylinder-piston units 30 diverge outwardly from each other in the upward direction.

Figure 7:
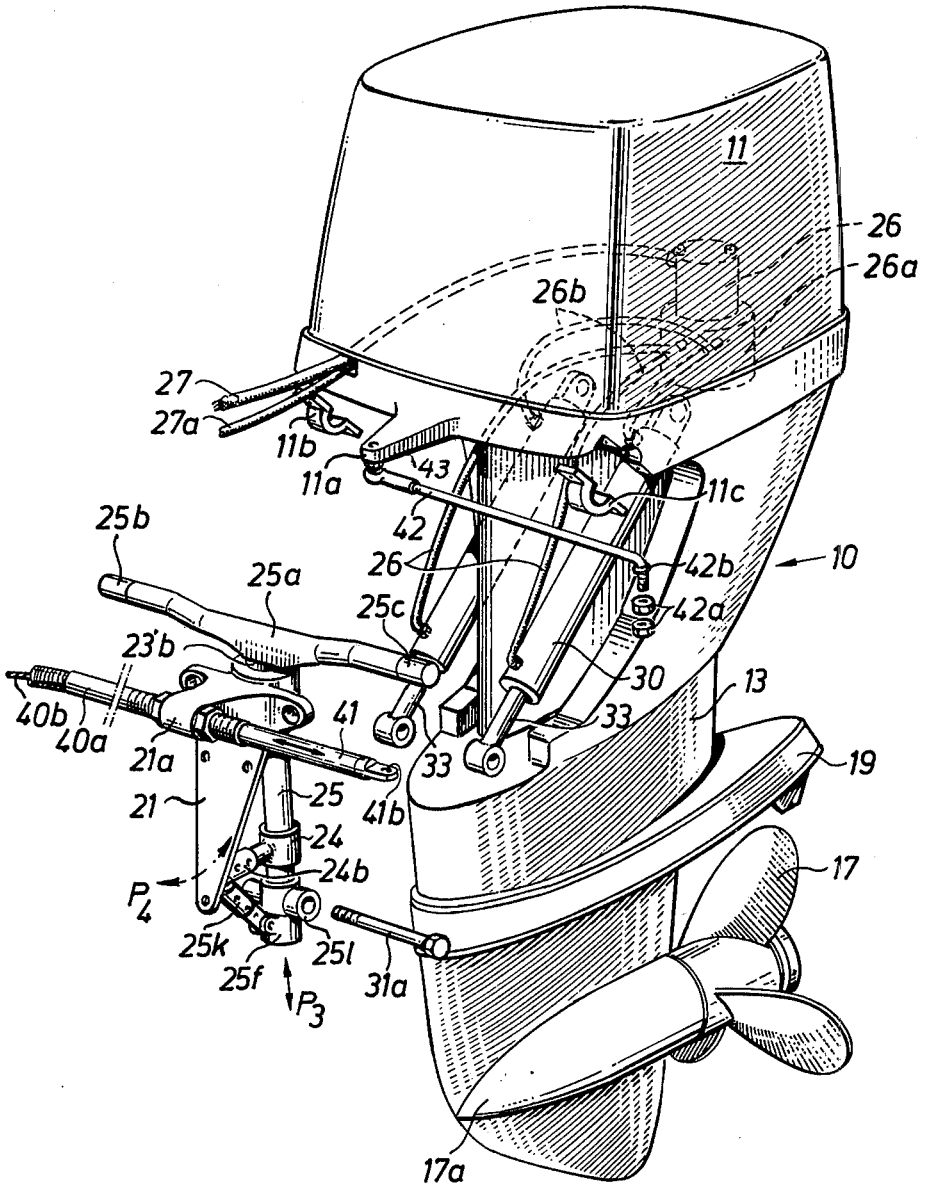
FIG. 7 is a perspective exploded view of a modified embodiment of the invention.

The cylinder-piston units may, if desired, also, as shown in FIG. 7, be reversely mounted, i.e., with the piston portions 33 connected to the steering shaft instead of to the motor.

Figure 4:
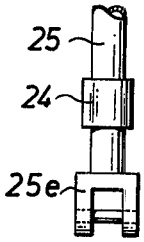

With less powerful and therefore also lighter motors one single cylinder-piston unit 30 may be sufficient, and in this case, of course, such unit is arranged in the symmetry plane of the motor and connected to the steering shaft 25 for instance by means of a yoke 25*e* as seen in FIG. 4.

Also a single cylinder-piston unit 30*a* (FIG. 3) for height trimming is attached in a similar manner, in that the yoke 25*e* is arranged at the cup-shaped bearing 25*f*.

The non-parallel arrangement of the steering shaft 25 and the boat transom 20, shown in FIG. 4, brings with it among other things the advantage that in the region of the lower bearing 24 there is enough space for the lower ends of both cylinder-piston units 30 and the elements for connecting them to the steering shaft, even when the motor in a steering operation is turned into an extreme steering angle relative to the longitudinal axis of the boat.

In the motor housing 11, for instance under the starting motor 12*a*, a pump 26 and reservoir 26*a* for hydraulic fluid are arranged. The cylinder-piston unit or units 30, and if applicable also 30*a* (FIG. 3), are supplied via hoses 26*b*, 26*c* with pressurized fluid. The controls of the pump 26, (not shown), are operated via an electrical line 27 from the driver's station. It will be appreciated that the relatively small pump 26 may be arranged under the housing 11 at several different locations as desired. However, among the several possible locations one is selected that guarantees that the pump will remain operative in all possible positions of tilt of the motor when mounted on the boat, i.e. substantially in all positions lying between the two extreme positions shown in FIGS. 5 and 6 respectively. Due to the fact that the hydraulic pump is arranged adjacent to the motor itself and preferably under the shroud, the construction is simplified, since the electronic equipment may be the same as used for the motor.

Trimming involves relatively small swinging movements of the motor 10 around the transverse beam 25*a*. For rough trimming, which is made when the motor for the first time is mounted onto a particular boat, the position of the steering shaft relative the boat transom may be adjusted into approximate position by steps, for instance in the manner shown in FIG. 6 or FIG. 7, where the arm 24*b* of the lower bearing 24 is telescopic and the upper bearing 23 is attached to the transom attachment 21 by a pivot 23*b* having a transverse horizontal axis.

Tilting of the motor 10 is obtained by strong swinging upwards around the transverse beam 25*a*, as it is shown in FIG. 6, where the normal operating position of the motor corresponding to FIG. 5 is represented by broken lines. As seen in FIG. 6, the motor has been tilted through approximately 70° and the angle $\alpha$ has become still more acute. It is apparent that for resetting the motor 10 to its normal position, no cylinder-piston force will be required, it is preferred, particularly with regard to the trimming movements, that the cylinder-piston units 30 and 30*a* be double-acting.

From FIGS. 5 and 6 it is apparent that when the motor 10 is swung around the transverse beam 25*a*, the position of the axis SA of the steering shaft 25 is displaced relative to the leg 13 and relative to the gear and propeller housing 17*a*. By further contraction of the piston of the cylinder-piston unit 30, for instance by a distance *c* (FIG. 5), the axis SA is displaced in the direction of the arrow P2 and a situation of over-steering (or possibly reduced under-steering) arises. When the piston-cylinder unit is extended, axis SA is displaced in the direction of the arrow P1 and a situation of under-steering (or reduced over-steering) is achieved. With known hydraulically trimable and tiltable outboard motors, the position of the steering shaft relative to the motor 10 and leg 13 are not changed since the steering shaft tilts with the motor about the horizontal tilt axis. Thus, according to the invention the over- or under-steering condition may be remotely controlled from the remote driver's station.

In the perspective view according to FIG. 7, the same reference numerals have been used as in the preceeding drawings. The cylinder-piston units 30 have their piston portions 33 oriented downwardly, which advantageously permits the supply hoses 26*b*, 26*c* to be of constant length. The cylinder-piston units 30 are attached to the steering shaft 25 by means of a bolt 31*a* which passes through a transversely oriented sleeve 251 at the lower end of the steering shaft. The lower bearing 24 of the steering shaft is attached by means of a telescopic arm 24*b* to the transom attachment plate 21 which in its turn is attachable to the transom of the boat so that due to the pivot connection 23'*b*, which is a ball shaped bearing, the steering shaft 25 may be adjusted in the directions of the arrows P4.

In FIG. 7 there is shown another possibility of height trimming in the direction of the arrow P3 by means of a length-adjustable link 25*k* connecting the transom attachment 21 with the cup-shaped bearing 25*f*. Link 25*k* is step-adjustable by a plurality of pin-receiving openings.

The motor 10 is attached to the end portions 25*b*, 25*c* of the transverse beam 25 by means of cap bearings 11*b*, 11*c*.

For steering of the motor, the casing 40*a* of a control cable 40*b* is fixedly anchored in the attachment portion 21*a* which is fixed to plate 21. The cable core 40*b* terminates in a rod 41 which is connected to the ball attachment 11*a* on the steering arm portion 43 of the motor by means of a shaft 42. The bent end portion 42*b* of the shaft 42 passes through an opening 41*b* at the free end of the rod 41 and is secured by the nuts 42*a*.

Cables 27*a* for the throttle and gear control extend adjacent to the electrical line 27 for the control of the reversible pump 26.

While the invention has been described with respect to a certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In an outboard motor comprising a motor and a transom mounting bracket comprising first bearing means establishing an upright steering axis for said motor, a T-shaped swingable mounting element comprising an upright shaft rotatably disposed in said bearing means and having an upper end and a lower end portion and said element further comprising a horizontal transverse beam fixed to said shaft at its said upper end and disposed above said bearing means, said beam having opposite terminal end portions, second bearing means tiltably supportingly connecting said motor to said terminal portions, said lower end portion extending below said second bearing means, said motor including a connection portion disposed spacedly rearwardly of said second bearing means, and tilt adjusting means connected between said lower end portion and said connection portion.

2. The combination according to claim 1 wherein said first bearing means comprises an upper and a lower bearing end spaced along said upright axis, wherein the distance along said shaft between said beam and said lower end portion is greater than the distance between said bearing ends, and wherein means interposed between said bracket and said beam are provided for supporting said shaft with said beam spacedly above said upper end of said first bearing means.

3. The combination according to claim 2 wherein said shaft supporting means are adjustable to adjust the spacing of said beam above said upper end of said first bearing means.

4. The combination according to claim 3 wherein said shaft supporting means comprise a variable length link, wherein said bracket includes a link connection portion disposed higher than said lower end portion of said shaft, said link being connected between said lower end portion of said shaft and said link connection portion of said bracket.

5. The combination according to claim 4 wherein said link comprises manually adjustable relatively slideable elements and means to lock said elements in selected adjusted relative positions.

6. The combination according to claim 4 wherein said link comprises a hydraulic cylinder and piston unit.

7. The combination according to claim 4 wherein a thrust bearing connects said link to said lower end portion of said shaft.

8. The combination according to claim 1 wherein said tilt adjusting means comprises a hydraulic cylinder pivotally attached to said motor, a hydraulic pump carried by said motor, and a hydraulic connection between said cylinder and said pump.

9. The combination according to claim 8 wherein said pump includes an electric operating motor provided with remote control wires extending from said outboard motor.

10. The combination according to claim 1 wherein said tilt adjusting means comprises a cylinder and piston unit, a pivot connection connecting the cylinder of said unit to said connection portion of said motor, and a pivot connection connecting the piston of said unit to said lower end portion of said shaft, said pivot connections having axes parallel to the axis of said second bearing means.

11. In an outboard motor comprising a motor a transom mounting bracket comprising an upper bearing element and an axially aligned lower bearing element disposed spacedly below said upper element, said elements establishing an upright steering axis for said motor, a T-shaped swingable mounting element comprising an upright shaft rotatably disposed in said bearing elements and said shaft having an upper end and a connection portion disposed below said upper bearing element, and said mounting element further comprising a horizontal transverse beam attached to said shaft at said upper end thereof, said beam being disposed above said upper bearing element and having opposite terminal end portions, bearing means tiltably supportingly connecting said motor to said terminal end portions, said motor including a motor connection portion disposed spacedly rearwardly of said bearing means, and tilt adjusting means connected between said connection portion of said shaft and said motor connection portion.

12. The combination according to claim 11 wherein said connection portion of said shaft is disposed below said lower bearing element.

13. The combination according to claim 11 wherein said tilt adjusting means comprises a cylinder and piston unit, a pivot connection connecting the cylinder of said unit to said connection portion of said motor, and a pivot connection connecting the piston of said unit to said lower end portion of said shaft, said pivot connections having axes parallel to the axis of said second bearing means to said connection portion of said shaft, said pivot connections having axes parallel to the axis of said bearing means.

14. In an outboard motor comprising a motor and a transom mounting bracket comprising first bearing means establishing an upright steering axis for said motor, a T-shaped swingable mounting element comprising an upright shaft rotatably disposed in said bearing means and having an upper end and a lower portion below said upper end, said element further comprising a horizontal transverse beam fixed to said shaft at its said upper end and disposed above said bearing means, said beam having opposite terminal end portions, second bearing means tiltably supportingly connecting said motor to said terminal portions, said lower portion extending below said second bearing means, said motor including a connection portion disposed spacedly rearwardly of said second bearing means, and tilt adjusting means connected between said lower portion and said connection portion.

15. The combination according to claim 14 wherein said tilt adjusting means comprises a hydraulic cylinder pivotally attached to said motor, a hydraulic pump carried by said motor, and a hydraulic connection between said cylinder and said pump.

* * * * *